US007857148B2

(12) United States Patent
Roeske

(10) Patent No.: US 7,857,148 B2
(45) Date of Patent: Dec. 28, 2010

(54) JAR DISPENSER

(76) Inventor: Pauline R. Roeske, 66 N. Spring Trellis Cir., Spring, TX (US) 77382

( * ) Notice: Subject to any disclaimer, the term of this patent is extended or adjusted under 35 U.S.C. 154(b) by 383 days.

(21) Appl. No.: 12/104,109

(22) Filed: Apr. 16, 2008

(65) Prior Publication Data

US 2009/0261048 A1 Oct. 22, 2009

(51) Int. Cl.
*A47F 1/04* (2006.01)
*A47F 7/00* (2006.01)

(52) U.S. Cl. ..... 211/59.3; 312/72; 221/279; 221/247

(58) Field of Classification Search ..... 211/10, 211/85.4, 14, 15, 51, 59.2, 59.3, 74, 76, 85.5; 221/306, 247, 248, 249, 250, 269, 270, 151, 221/152, 153, 227, 255, 279; 312/60, 61, 312/71, 72, 73
See application file for complete search history.

(56) References Cited

U.S. PATENT DOCUMENTS 495,351 A * 4/1893 Luster ..... 221/131
1,151,064 A * 8/1915 Swift ..... 221/63
1,205,844 A * 11/1916 Berry ..... 221/131
1,841,926 A * 1/1932 Zuehl ..... 221/75
2,460,396 A * 2/1949 Rifkin ..... 221/279
2,522,896 A * 9/1950 Rifkin et al. ..... 221/260
4,300,693 A 11/1981 Spamer
4,729,481 A 3/1988 Hawkinson et al.
4,762,236 A 8/1988 Jackle, III et al.
4,898,282 A 2/1990 Hawkinson et al.
5,806,690 A 9/1998 Johnson et al.
5,833,076 A * 11/1998 Harres et al. ..... 211/51
7,513,390 B2 * 4/2009 Artsiely ..... 221/152
7,686,185 B2 * 3/2010 Zychinski ..... 221/279

* cited by examiner

*Primary Examiner*—Darnell M Jayne
*Assistant Examiner*—Stanton L Krycinski
(74) *Attorney, Agent, or Firm*—Dale J. Ream

(57) ABSTRACT

A jar dispenser includes a housing defining a row that accommodates multiple jars of baby food in single file atop a planar floor. A pushplate is configured for movement along the row. A biasing member is in communication with the pushplate to bias the pushplate from a housing back side toward a housing front side. The device includes a door adjacent the row at the housing front side, the door being pivotal to restrict access to the row when at a closed position and to allow access to the row when at open and load positions. A first biasing member biases the door toward the closed position. A door catch is positioned to interact with the door when the door is at the load position. A second biasing member biases the door to bias the door to interact with the door catch when the door is at the load position.

20 Claims, 9 Drawing Sheets

JAR DISPENSER

BACKGROUND OF THE INVENTION

This invention relates generally to storage and dispensing devices and, more particularly, to a device for storing and dispensing jars such as baby food containers. The present device enables delicate containers, such as glass jars, to be protected from breakage that may otherwise result from stacking or from becoming inadvertently dislodged from a stored position while removing another jar.

Food specially formulated for infants is often packaged in glass jars. While these jars are stackable, such as in a pantry or kitchen cabinet, such stacking of jars may lead to jar breakage. Specifically, baby food jars are relatively small and, therefore, a stack of such small jars may become inadvertently bumped or knocked over in the process of removing a desired jar. A large quantity of small baby food jars typically needs to be stored simultaneously in that each jar may only contain a sufficient quantity of food for one feeding. In addition, these jars may be dropped or a stack of them knocked over during the process of filling a cabinet with a new quantity of jars.

Organization of multiple jars of baby food is another problem experienced with large quantities of baby food. Entire stacks of baby food jars may need to be moved and investigated in order to find a desired type of food for a feeding. For example, a mother or other caregiver may sort through jars of vegetables, meat, and fruit jars in order to find a desired jar of oatmeal. Similarly, the jars of miscellaneous varieties of baby food may need to be sorted in order to know what types need to be purchased from the grocery store.

Various devices have been proposed in the art for storing and dispensing food containers. Although assumably effective for their intended purposes, the existing proposals do not provide an adequate solution to the myriad of needs presented above, namely, to store, organize, protect, and dispense baby food jars.

Therefore, it would be desirable to have a jar dispenser that stores multiple baby food jars in a convenient, accessible, organized manner and which also minimizes the risk of jar breakage during storage. Further, it would be desirable to have a jar dispenser which provides convenience and safety in adding to a quantity of jars already being stored. In addition, it would be desirable to have a jar dispenser that enables stored jars of baby food to be dispensed in a safe and controlled manner.

SUMMARY OF THE INVENTION

A device for holding and dispensing baby food jars includes a housing having a front side, a back side, generally opposed ends, a top, a bottom, a generally planar floor, and a row extending from the front side toward the back side. The row is configured to accommodate multiple jars of baby food in single file atop the generally planar floor. A pushplate is configured for movement along the row. A biasing member is in communication with the pushplate to bias the pushplate from the housing back side toward the housing front side.

The device includes a door adjacent the row at the housing front side, the door being pivotally coupled to the housing to restrict access to the row when at a closed position and to allow access to the row when at open and load positions. A first biasing member is in communication with the door to bias the door toward the closed position. A door catch is positioned to interact with the door when the door is at the load position. A second biasing member is in communication with the door to bias the door to interact with the door catch when the door is at the load position.

Therefore, a general object of this invention is to provide a jar dispenser for holding and dispensing baby food jars.

Another object of this invention is to provide a jar dispenser, as aforesaid, that allows multiple baby food jars to be held in a row and dispensed one-by-one in a controlled and safe manner.

Still another object of this invention is to provide a jar dispenser, as aforesaid, that enables baby food jars to be stored, organized, protected, and dispensed.

Yet another object of this invention is to provide a jar dispenser, as aforesaid, that enables additional jars of baby food to be conveniently and safely added.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A device for holding and dispensing baby food jars will now be described in detail with reference to FIG. 1 through FIG. 9 of the accompanying drawings. More particularly, the baby food jar dispenser 100 includes a housing 110 and a door 130.

Figure 1:
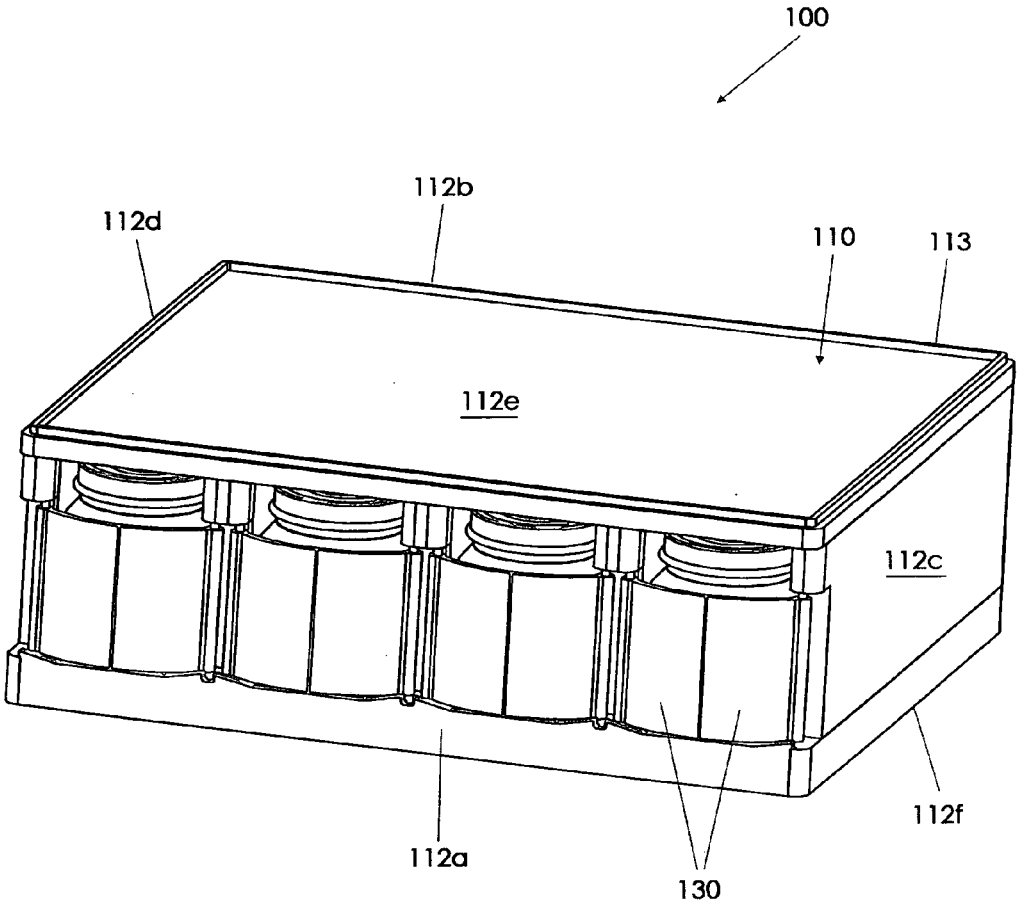
FIG. 1 is a perspective view of a jar dispenser according to a preferred embodiment of the present invention.
Figure 2:
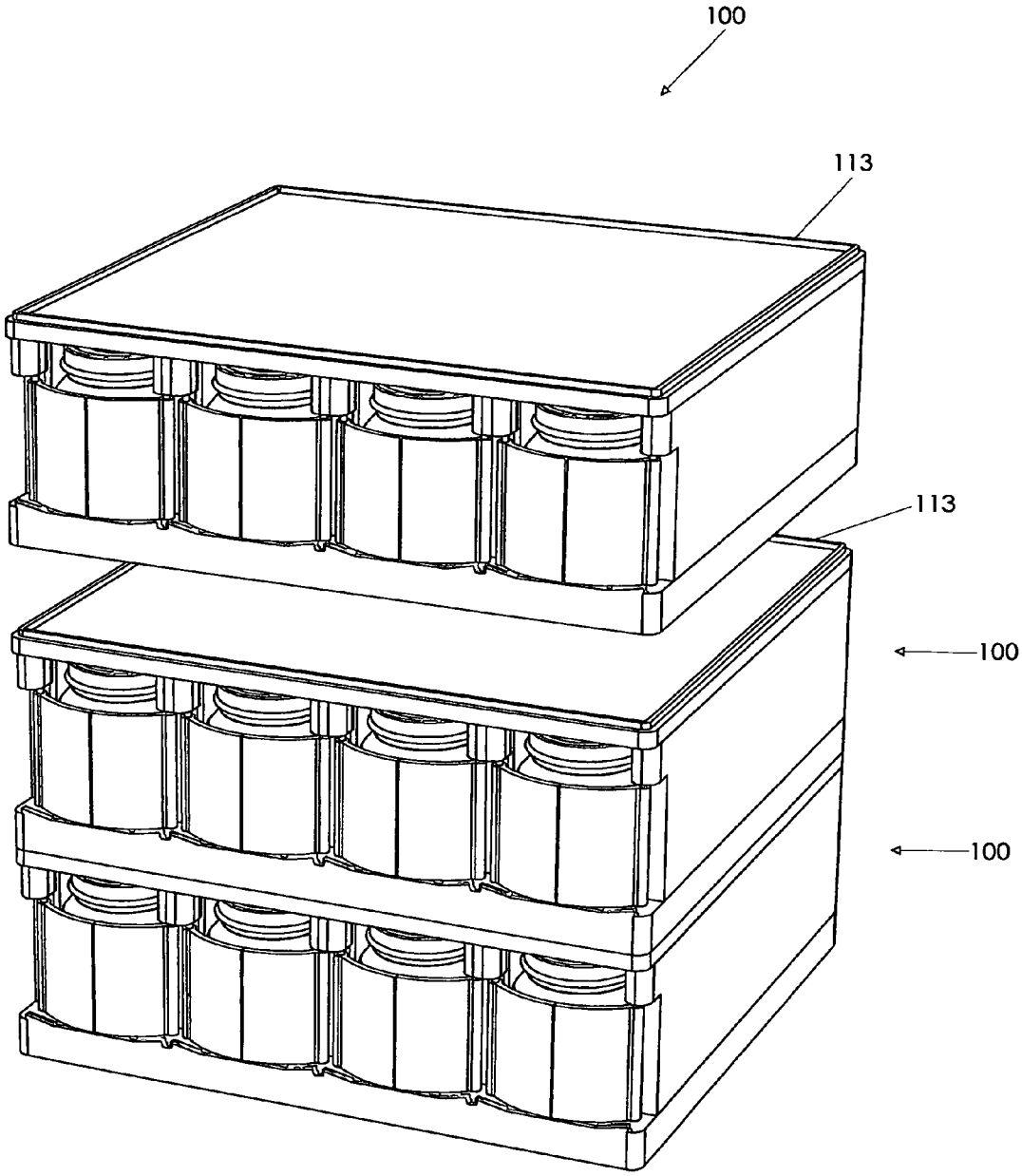
FIG. 2 is a perspective view of multiple jar dispensers as in FIG. 1 being stacked atop one another.
Figure 3A:
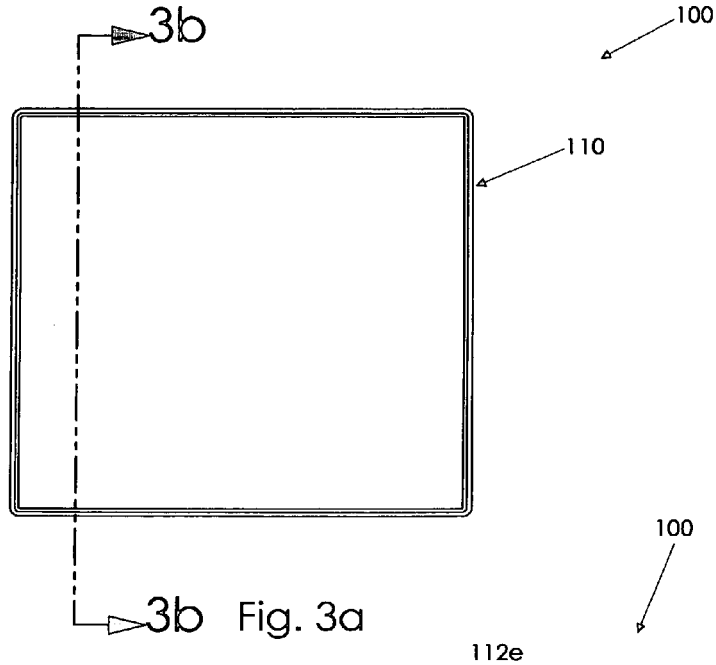
FIG. 3*a* is a top view of a jar dispenser as in FIG. 1.
Figure 3B:
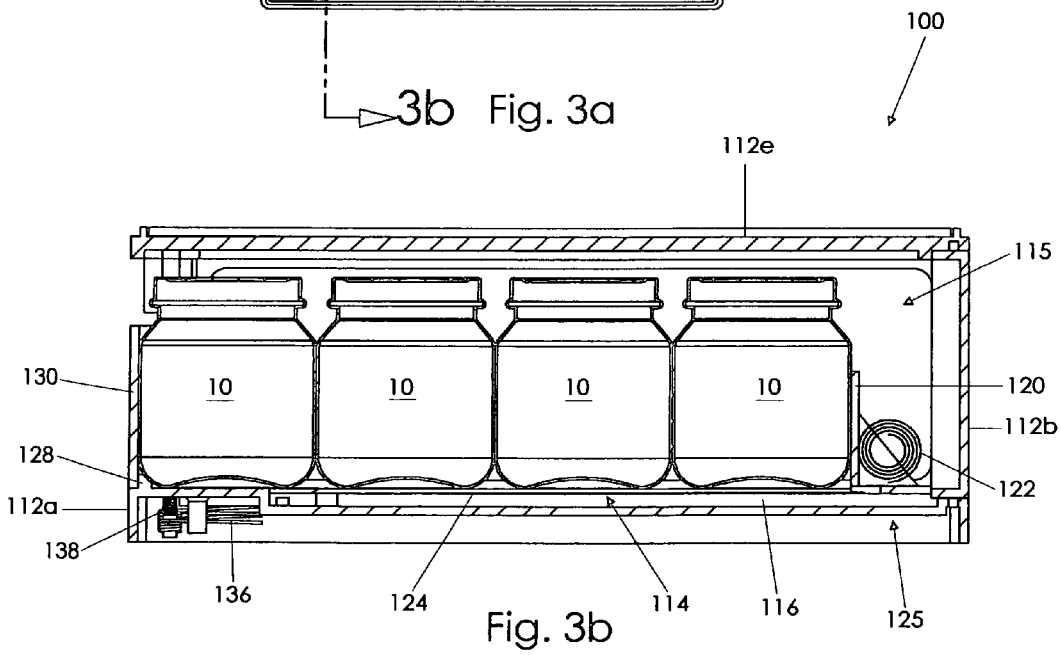
FIG. 3*b* is a sectional view taken along line 3*b*-3*b* of FIG. 3*a;*

As shown in FIG. 1, the housing 110 has a front side 112*a*, a back side 112*b*, generally opposed ends 112*c*, 112*d*, a top 112*e*, and a bottom 112*f*. The housing top 112*e* may have a configuration 113 that is complementary to a configuration of the housing bottom 112*f* so that multiple baby food jar dispensers 110 may be stacked securely atop one another, as shown in FIG. 2. The housing 110 also includes a generally planar floor 114 (FIG. 3*b*) and at least one row 115 extending from the front side 112*a* toward the back side 112*b*. Each row 115 is configured to accommodate multiple jars of baby food 10 in single file atop the generally planar floor 114, as shown in FIG. 3*b*. Because each row 115 is substantially identical to each other row 115 if multiple rows 115 are included, a single row 115 is discussed in detail and referred to herein. It should be understood that elements related to (or interacting with) the single row 115 discussed herein may similarly be multiplied to relate to (or interact with) each other row 115.

Referring to FIG. 3*b*, a pushplate 120 may be movable along the row 115 from generally adjacent the housing back side 112*b* toward the housing front side 112*a*, and a biasing member 122 may be in communication with the pushplate 120 to bias the pushplate 120 from the housing back side 112*b* toward the housing front side 112*a*. The biasing member 122 may be, for example, a spring, a rubber band, or any other biasing element. The biasing member 122 shown in FIG. 3*b* is a spiral spring that extends either along or below the generally planar floor 114 when the pushplate 120 is adjacent the housing back side 112*b*. A lip 128 may be in communication with the row 115 to slow the movement of the baby food jars 10 passing through the housing front side 112*a* from the row 115 due to pressure from the pushplate 120.

The housing 110 may include a channel 116 (FIG. 3*b*) lowerly adjacent the row 115, and an insert 125 that includes the pushplate 120, the biasing member 122, and an elongate base 124 may be included. More particularly, the elongate base 124 may be located in the channel 116, and the elongate base 124 may define at least a portion of the generally planar floor 114 when the elongate base 124 is located in the channel 116 and attached to the housing 110. The biasing member 122 shown in FIG. 3*b* is a spiral spring 122 that extends either along or below the elongate base 124 when the pushplate 120 is adjacent the housing back side 112*b*. Use of the insert 125 may aid in manufacturing the baby food jar dispenser 100.

Figure 4A:
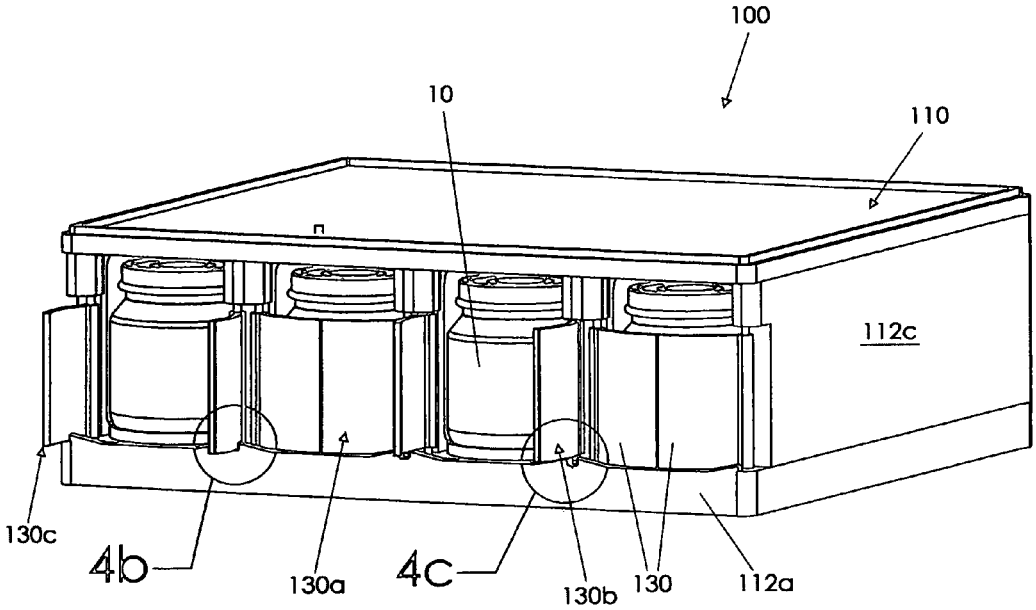
FIG. 4*a* is a perspective view of a jar dispenser as in FIG. 1 with some of the doors in an open configuration and other doors in a closed configuration.
Figure 7:
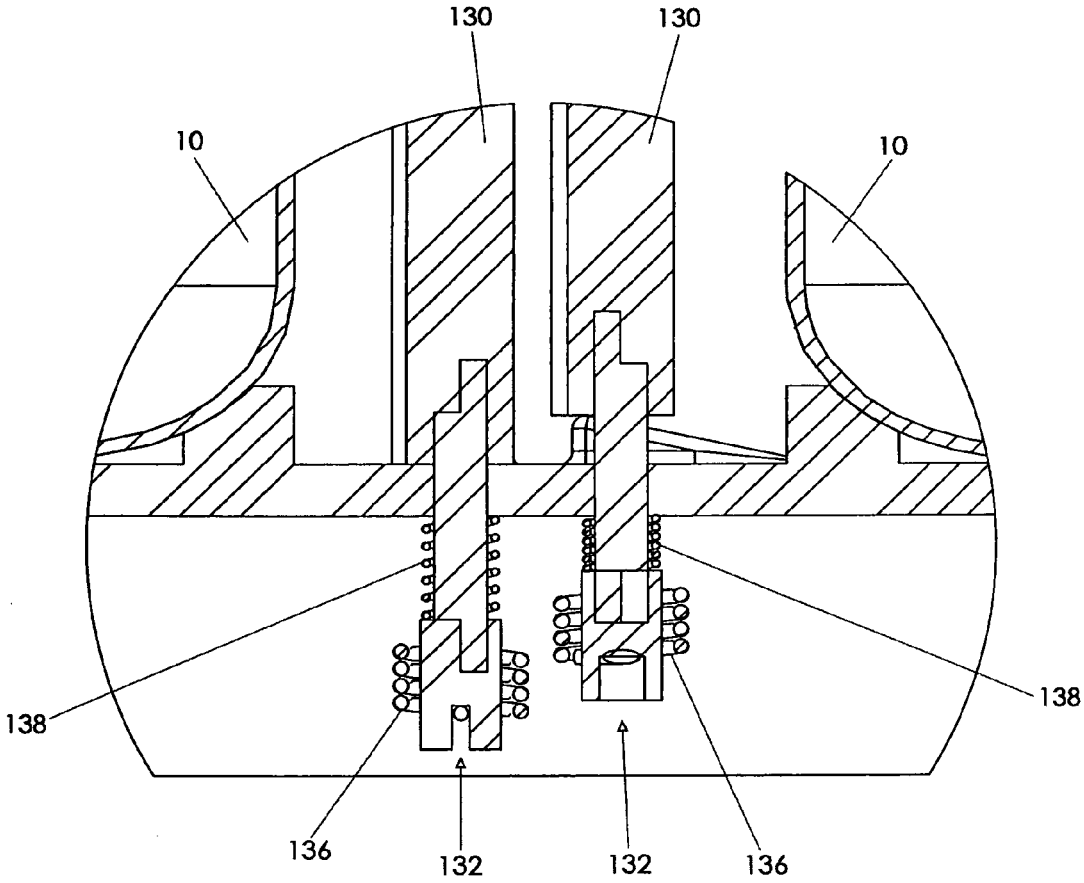
FIG. 7 is an isolated view on an enlarged scale taken from a portion of the jar dispenser as in FIG. 6*b;*
Figure 8A:
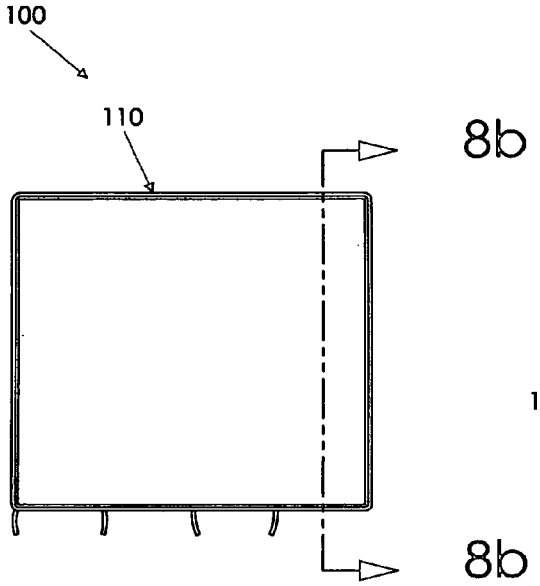
FIG. 8*a* is a top view of the jar dispenser as in FIG. 4*a;*
Figure 8B:
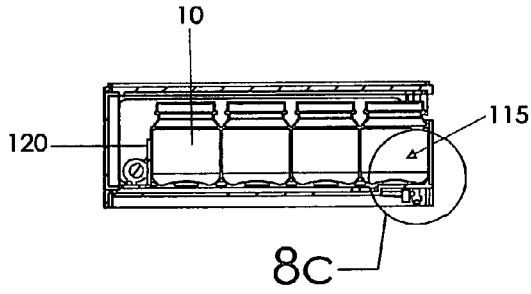
FIG. 8*b* is a sectional view taken along line 8*b*-8*b* of FIG. 8*a;*
Figure 8C:
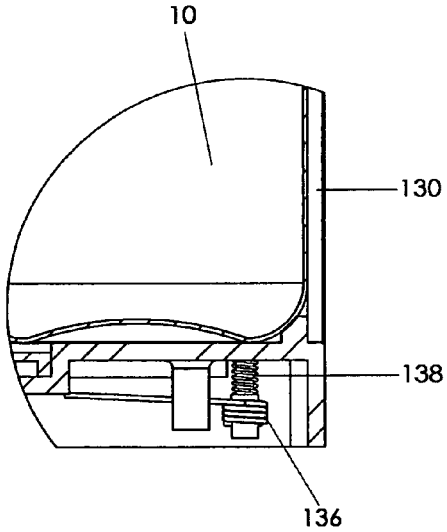
FIG. 8*c* is an isolated view on an enlarged scale taken from a portion of the jar dispenser as in FIG. 8*b*.
Figure 9:
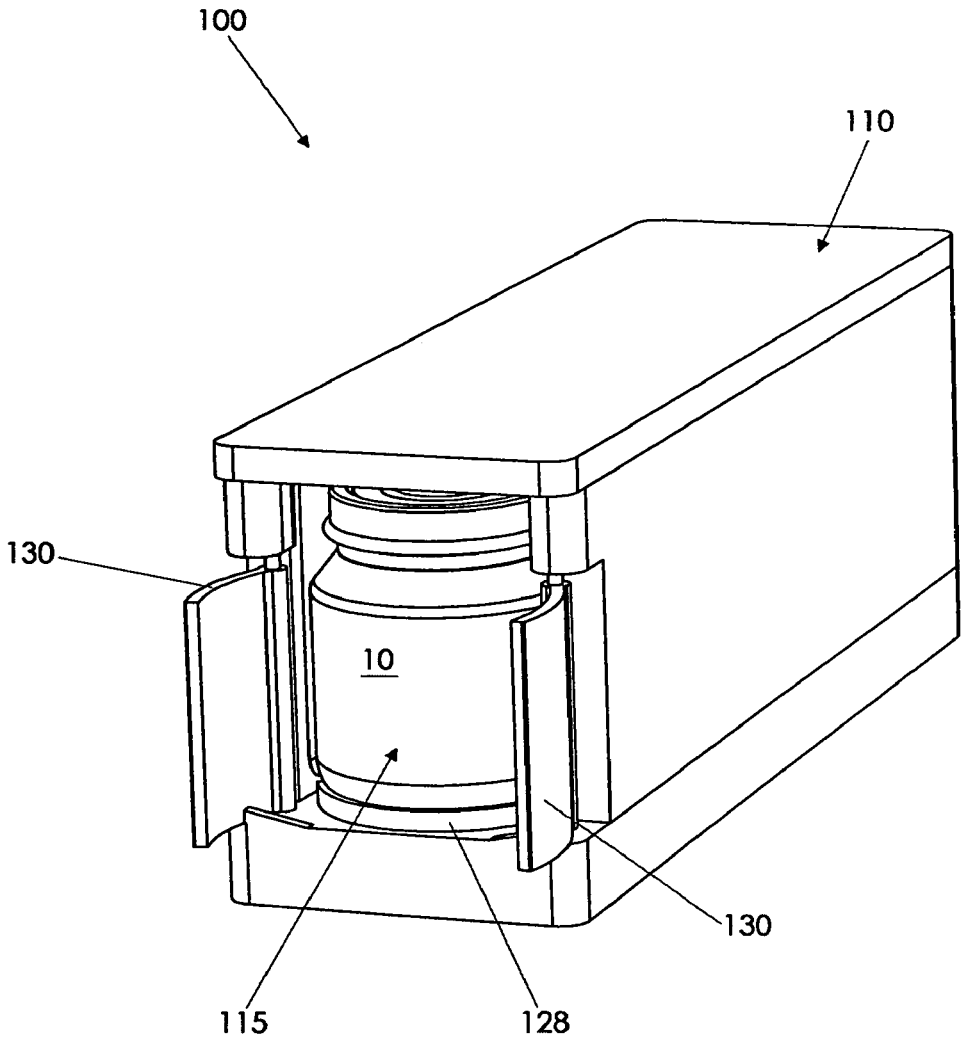
FIG. 9 is a perspective view of a jar dispenser according to the preferred embodiment but having only a single row.

As shown in FIG. 4*a*, at least one door 130 may be adjacent the row 115 at the front side 112*a* of the housing 110. The door 130 is pivotally coupled to the housing 110 to restrict access to the row 115 (and keep the jars 10 inside the housing 110) when at a closed position 130*a* and allow access to the row 115 (and allow a jar 10 to exit the housing 110) when at open and load positions 130*b*, 130*c*. As can be seen by comparing FIG. 4*b* to FIG. 4*c*, the open position 130*b* is between the closed position 130*a* and the load position 130*c*. The door 130 may be pivotable along a generally vertical axis of rotation 132, and the door 130 may be movable vertically along the axis 132, as shown in FIG. 7.

The door 130 may have a convex configuration complementary to the baby food jars 10 (FIG. 9), and a set of doors 130 may be adjacent the row 115 at the front side 112*a* of the housing 110. In one embodiment, as shown in FIG. 1, a respective door 130 extends a distance of approximately half a width of the row 115 when the door 130 is at the closed position 130*a*, and a set of doors 130 collectively extends a distance approximately equal to a width of the row 115 when the doors are at the closed position 130*a*. As each door 130 may be substantially similar to (e.g., a mirror image of) the other door 130, a single door 130 is discussed in detail and referred to herein. It should be understood that elements related to (or interacting with) the door 130 discussed herein may similarly be multiplied to relate to (or interact with) other doors 130.

Figure 5:
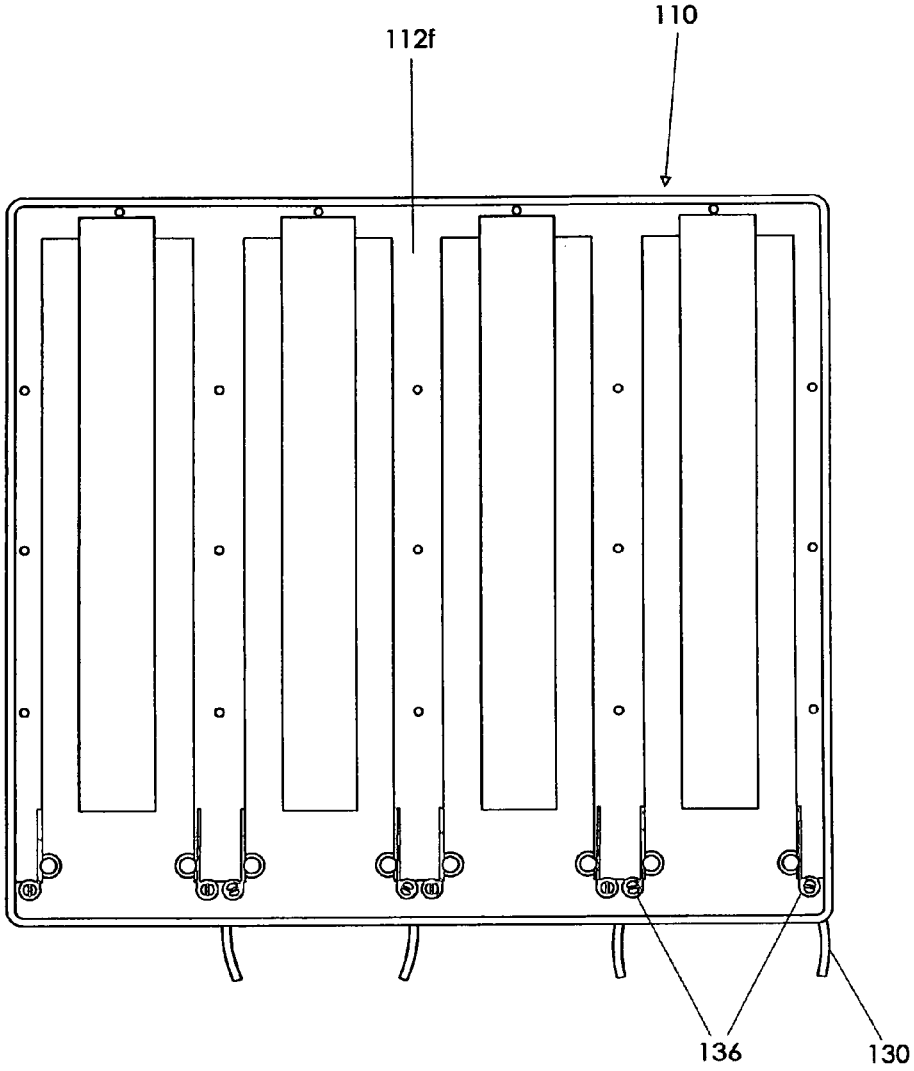
FIG. 5 is a bottom view of the jar dispenser as in FIG. 4*a;*
Figure 6A:
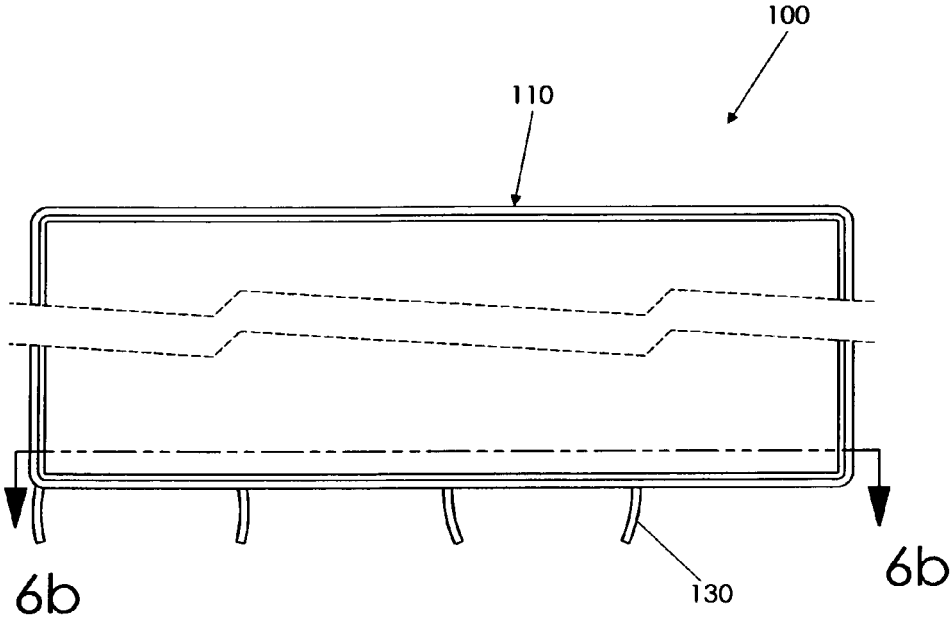
FIG. 6*a* is a top view of the jar dispenser as in FIG. 4*a;*
Figure 6B:
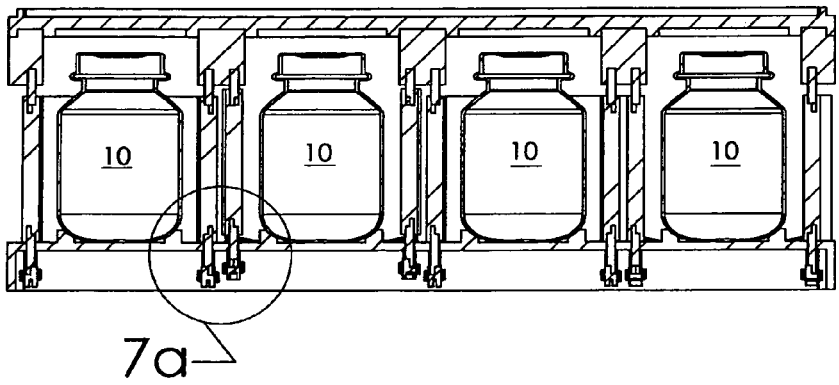
FIG. 6*b* is a sectional view taken along line 6*b*-6*b* of FIG. 6*a;*

A first biasing member 136 (FIGS. 5 and 7) may be in communication with the door 130 to bias the door toward the closed position 130*a*. The first biasing member 136 may be, for example, a spring, a rubber band, or any other biasing element. The first biasing member 136 shown in FIGS. 5 and 7 is a torsion spring.

Figure 4B:
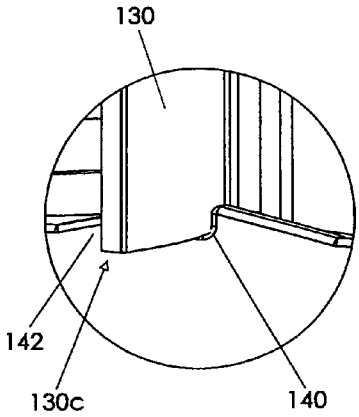
FIG. 4*b* is an isolated view on an enlarged scale taken from a portion of the jar dispenser as in FIG. 4*a;*
Figure 4C:
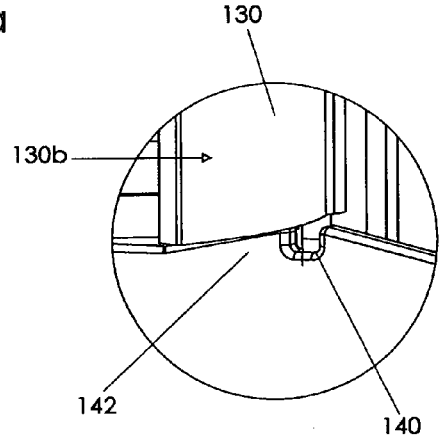
FIG. 4*c* is an isolated view on an enlarged scale taken from a portion of the jar dispenser as in FIG. 4*a;*

As detailed in FIGS. 4*b* and 4*c*, a door catch 140 may be at the housing front side 112*a*. The door catch 140 may be positioned to interact with the door 130 when the door 130 is at the load position 130*c*, and a ramp 142 may lead to the door catch 140. A second biasing member 138 (FIG. 7) may be in communication with the door 130 to bias the door 130 to interact with the door catch 140 when the door 130 is at the load position 130*c*. The second biasing member 138 may further bias the door 130 to interact with the ramp 142 as the door rotates toward the door catch 140. The second biasing member 138 may be, for example, a spring, a rubber band, or any other biasing element. The second biasing member 138 shown in FIG. 7 is a compression spring.

In use, the door 130 is initially at the closed configuration 130*a* due to the biasing member 136, and the pushplate 120 is toward the housing front side 112*a* due to the biasing member 122. A user may move the door 130 (i.e., by rotating the door 130 about the axis 132) from the closed configuration 130*a* past the open position 130*b* (FIG. 4*c*) to the load position 130*c* (FIG. 4*b*). In moving the door 130 to the load position 130*c*, the second biasing member 138 may cause the door 130 to interact with the ramp 142 and then cause the door 130 to interact with the door catch 140 (FIG. 4*b*). Interaction between the door catch 140 and the door 130 may cause the door 130 to remain at the load position 130*c*, and the user may insert the jars of baby food 10 into the row 115 without having to physically maintain the door 130 at the open position 130*b* or the load position 130*c*. By inserting the jars 10 into the row 115, the pushplate 120 is moved toward the housing back side 112*b*. Once the jars 10 are inside the housing 110 (and particularly inside the row 115), the user may overcome the force of the second biasing member 138, and the door 130 may move from the load position 130*c* to the closed position 130*a* due to the first biasing member 136. The housing 110 may be stacked atop or below another housing 110, maximizing useful storage space.

When the user wants to retrieve the jar 10 from the baby food jar dispenser 100, he may open the door 130, and the pushplate 120 may push the jar 10 through the front side 112*a* due to the biasing member 122. The door 130 then returns to the closed position 130*a* due to the first biasing member 136, and the lip 128 may help ensure another jar 10 does not exit the front side 112 before the door 130 returns to the closed position 130*a*. As such, the user may safely and compactly store and then access the baby food jars 10.

It is understood that while certain forms of this invention have been illustrated and described, it is not limited thereto except insofar as such limitations are included in the following claims and allowable functional equivalents thereof.

The invention claimed is:

1. A device for holding and dispensing baby food jars, said device comprising:

a housing having a front side, a back side, generally opposed ends, a top, a bottom, a generally planar floor, and a row extending from said front side toward said back side; said row being configured to accommodate multiple jars of baby food in single file atop said generally planar floor;

a pushplate movable along said row;

a biasing member in communication with said pushplate to bias said pushplate from said housing back side toward said housing front side;

a door adjacent said row at said housing front side, said door being pivotally coupled to said housing to restrict access to said row when at a closed position and allow access to said row when at open and load positions, said open position being between said closed position and said load position;

a first biasing member in communication with said door to bias said door toward said closed position;

a door catch at said housing front side, said door catch being positioned to interact with said door when said door is at said load position; and a second biasing member in communication with said door to bias said door to interact with said door catch when said door is at said load position.

2. The device of claim 1, further comprising a lip in communication with said row to slow the movement of said baby food jars passing through said housing front side from said row.

3. The device of claim 1, wherein said housing top has a configuration complementary to a configuration of said housing bottom.

4. The device of claim 1, wherein said door extends a distance of approximately half a width of said row when said door is at said closed position.

5. The device of claim 4, further comprising a lip in communication with said row to slow the movement of said baby food jars passing through said housing front side from said row, and wherein said housing top has a configuration complementary to a configuration of said housing bottom.

6. The device of claim 1, wherein:

said biasing member in communication with said pushplate is a spiral spring extending along or below said generally planar floor when said pushplate is adjacent said housing back side;

said first biasing member in communication with said door is a spring; and said second biasing member in communication with said door is a spring.

7. The device of claim 1, wherein:

said housing includes a channel lowerly adjacent said row;

an insert includes said pushplate, said biasing member in communication with said pushplate, and an elongate base;

said biasing member in communication with said pushplate is a spiral spring extending along or below said elongate base;

said elongate base of said insert is located in said channel; and said elongate base of said insert defines at least a portion of said generally planar floor when said elongate base of said insert is located in said channel.

8. The device of claim 1, wherein:

a ramp leads to said door catch; and said second biasing member in communication with said door biases said door to interact with said ramp as said door rotates toward said door catch.

9. The device of claim 8, further comprising a lip in communication with said row to slow the movement of said baby food jars passing through said housing front side from said row, and wherein said housing top has a configuration complementary to a configuration of said housing bottom.

10. The device of claim 9, wherein said door has a convex configuration complementary to said baby food jars.

11. A baby food jar dispenser, comprising:

a housing having a front side, a back side, generally opposed ends, a top, a bottom, a generally planar floor, and a plurality of distinct rows extending from said front side toward said back side; each said row being configured to accommodate multiple jars of baby food in single file atop said generally planar floor;

a respective pushplate movable along each said row;

a respective biasing member in communication with each said pushplate to bias said pushplate from said housing back side toward said housing front side;

a respective set of doors adjacent each said row at said housing front side; each said door being pivotally coupled to said housing to move between a closed position restricting access to a respective row, an open position allowing access to said row, and a load position; said open position being between said closed position and said load position;

a respective first biasing member in communication with each said door to bias said door toward said closed position;

a respective door catch at said housing front side to interact with each said door, each said door catch being positioned to interact with a respective door when said door is at said load position, interaction between a respective door catch and a respective door causing said door to remain at said load position; and a respective second biasing member in communication with each said door to bias said door to interact with a respective door catch when said door is at said load position; and wherein each respective set of doors collectively extends a distance approximately equal to a width of said row when said doors are at said closed position.

12. The baby food jar dispenser of claim 11, wherein:

a respective ramp leads to each said door catch; and said second biasing members in communication with said doors bias said doors to interact with said ramps as said doors rotate toward said door catches.

13. The baby food jar dispenser of claim 12, further comprising a respective lip in communication with each said row to slow the movement of said baby food jars passing through said housing front side from said rows, and wherein said housing top has a configuration complementary to a configuration of said housing bottom.

14. The baby food jar dispenser of claim 13, wherein:

each said biasing member in communication with a pushplate is a spring;

each said first biasing member is a spring; and each said second biasing member is a spring.

15. The baby food jar dispenser of claim 11, further comprising a respective lip in communication with each said row to slow the movement of said baby food jars passing through said housing front side from said rows, and wherein said housing top has a configuration complementary to a configuration of said housing bottom.

16. A baby food jar dispenser, comprising:

a housing having a front side, a back side, generally opposed ends, a top, a bottom, a generally planar floor, and a row extending from said front side toward said back side; said row being configured to accommodate multiple jars of baby food in single file atop said generally planar floor;

a pushplate movable along said row;

a spring in communication with said pushplate to bias said pushplate from said housing back side toward said housing front side;

a door adjacent said row at said housing front side, said door being pivotally coupled to said housing to restrict access to said row when at a closed position and allow access to said row when at open and load positions, said open position being between said closed position and said load position, said door being pivotable along a generally vertical axis of rotation and being movable vertically along said axis;

a torsion spring in communication with said door to bias said door toward said closed position;

a door catch at said housing front side, said door catch being positioned to interact with said door when said door is at said load position, interaction between said door catch and said door causing said door to remain at said load position; and a compression spring in communication with said door to bias said door to interact with said door catch when said door is at said load position.

17. The baby food jar dispenser of claim 16, further comprising a lip in communication with said row to slow the movement of said baby food jars passing through said housing front side from said row, and wherein said housing top has a configuration complementary to a configuration of said housing bottom.

18. The baby food jar dispenser of claim 16, wherein said door extends a distance of approximately half a width of said row when said door is at said closed position.

19. The baby food jar dispenser of claim 16, wherein:

said housing includes a channel lowerly adjacent said row;

an insert includes said pushplate, said biasing member in communication with said pushplate, and an elongate base;

said biasing member in communication with said pushplate is a spiral spring extending along or below said elongate base;

said elongate base of said insert is located in said channel; and said elongate base of said insert defines at least a portion of said generally planar floor when said elongate base of said insert is located in said channel.

20. The baby food jar dispenser of claim 16, wherein:

a ramp leads to said door catch; and said second biasing member in communication with said door biases said door to interact with said ramp as said door rotates toward said door catch.

* * * * *